US009026008B2

(12) United States Patent
Iida

(10) Patent No.: US 9,026,008 B2
(45) Date of Patent: May 5, 2015

(54) DEVELOPING DEVICE HAVING DEVELOPER CONVEYING MEMBERS

(71) Applicant: Canon Kabushiki Kaisha, Tokyo (JP)

(72) Inventor: Takanori Iida, Noda (JP)

(73) Assignee: Canon Kabushiki Kaisha, Tokyo (JP)

( * ) Notice: Subject to any disclaimer, the term of this patent is extended or adjusted under 35 U.S.C. 154(b) by 151 days.

(21) Appl. No.: 13/727,714

(22) Filed: Dec. 27, 2012

(65) Prior Publication Data

US 2013/0177338 A1 Jul. 11, 2013

(30) Foreign Application Priority Data

Jan. 10, 2012 (JP) ..... 2012-002137

(51) Int. Cl.
*G03G 15/08* (2006.01)

(52) U.S. Cl.
CPC .... *G03G 15/0889* (2013.01); *G03G 2215/0822* (2013.01); *G03G 2215/0838* (2013.01); *G03G 2215/0827* (2013.01); *G03G 15/0893* (2013.01)

(58) Field of Classification Search
CPC ..... G03G 15/0889; G03G 15/0891; G03G 15/0893; G03G 2215/0822; G03G 2215/0827; G03G 2215/0838
USPC ..... 399/254, 255, 256
See application file for complete search history.

(56) References Cited

U.S. PATENT DOCUMENTS

| | | | | |
|---|---|---|---|---|
| 6,122,472 | A * | 9/2000 | Sako et al. | 399/254 |
| 7,715,763 | B2 | 5/2010 | Yoshida | |
| 2008/0085138 | A1 | 4/2008 | Yoshida | |
| 2009/0310984 | A1 * | 12/2009 | Sakatani et al. | 399/30 |
| 2012/0163874 | A1 * | 6/2012 | Hattori et al. | 399/254 |
| 2012/0189352 | A1 | 7/2012 | Yamauchi et al. | |

FOREIGN PATENT DOCUMENTS

| | | | |
|---|---|---|---|
| EP | 1909145 | A1 | 4/2008 |
| JP | 11-30913 | A | 2/1999 |
| JP | 11-202626 | A | 7/1999 |
| JP | 2005-91914 | A | 4/2005 |
| JP | 2008-90171 | A | 4/2008 |

* cited by examiner

*Primary Examiner* — David Gray
*Assistant Examiner* — Tyler Hardman
(74) *Attorney, Agent, or Firm* — Fitzpatrick, Cella, Harper & Scinto

(57) ABSTRACT

A developing device includes a developing chamber which supplies a developer to a developer bearing member, an agitating chamber connected at both ends to the developing chamber and disposed above the developing chamber, a first developer conveying member disposed within the developing chamber, and a second developer conveying member disposed within the agitating chamber. In addition, a third developer conveying member is disposed on a same axis as the first developer conveying member and able to convey the developer toward the developing chamber at a downstream side from a first connecting portion in a conveying direction of the first developer conveying member, and a supplying portion supplies developer to the third developer conveying member and is disposed at a position facing the third developer conveying member.

4 Claims, 6 Drawing Sheets

DEVELOPING DEVICE HAVING DEVELOPER CONVEYING MEMBERS

BACKGROUND OF THE INVENTION

1. Field of the Invention

The present invention relates to a developing device which develops an electrostatic latent image formed on an image bearing member by using a toner.

2. Description of the Related Art

As a conventional developing device, as illustrated in FIGS. 5A and 5B, a developing container 1200 is separated by a partition wall 1209, and a developing chamber 1206 and an agitating chamber 1207 are disposed up and down in a vertical direction, so as to save a horizontal space of an image forming apparatus. The partitioned developing chamber 1206 and agitating chamber 1207 communicate with each other at both ends to allow a developer t to flow therebetween.

At an upstream side of the agitating chamber 1207 in a developer conveyance direction, a replenishing port 1208 is provided. A toner replenished from the replenishing port 1208 is conveyed by a second conveying screw 1205 inside the agitating chamber 1207, while being agitated with a carrier of the developer t within the agitating chamber 1207.

In a communication portion S1 disposed at a downstream side of the second conveying screw 1205 in a conveyance direction, the developer t is pumped from the agitating chamber 1207 to the developing chamber 1206. The developer t pumped to the developing chamber 1206 is conveyed to a communication portion S2 provided at a downstream side of a first conveying screw 1204 in a conveyance direction by the first conveying screw 1204 inside the developing chamber 1206, and falls to the agitating chamber 1207. By repeating the above operation, the developer t is circulated.

In this case, the replenish toner needs to be sufficiently mixed and agitated with the carrier. Otherwise, a charging amount of the toner becomes insufficient. As a result, image unevenness or density difference occurs in a thrust direction due to insufficient agitation, or a toner which is not controlled by an electric field covers a white background.

Therefore, in order to sufficiently mix and agitate the toner with the carrier, it is preferable that an agitating distance be taken as long as possible. Also, when the toner is replenished to the developing chamber side, since the developing chamber faces a developing sleeve, it is feared that the replenish toner may be directly scattered. Therefore, it is preferable that the toner be replenished to the agitating chamber side. As the optimal position to meet the two points, the replenishing port 1208 is disposed at the upstream side of the agitating chamber 1207 in the developer conveyance direction.

On the other hand, a developing device, in which a developing chamber 1206 is disposed in a vertically lower portion and an agitating chamber 1207 is disposed in a vertically upper portion, is proposed (US2008085138A1). This configuration can save a horizontal space of an image forming apparatus and can also stably supply a developer to a developing sleeve. Since the circulation of the developer is affected by gravity, a larger amount of the developer exists in the developing chamber disposed in the vertically lower portion as compared with the agitating chamber disposed in the vertically upper portion. Thus, it becomes difficult to delay the supply of the developer from the developing chamber toward the developing sleeve.

However, in the configuration of US2008085138A1, as illustrated in FIG. 6, when a toner replenishing port 1208 is disposed at the upstream side of the agitating chamber 1207 in the developer conveyance direction, it is feared that the replenish toner and the developer may be insufficiently mixed and agitated.

That is, in the configuration illustrated in FIG. 6, the developer t is subjected to high pressure in a communication portion S1 in which the developer t is pumped from the developing chamber 1206 to the agitating chamber 1207. In the communication portion S1 in which high pressure is applied to the developer t, the replenish toner and the developer are most efficiently mixed and agitated.

However, since the toner replenished from the toner replenishing port 1208 is supplied to the developing sleeve without passing through the communication portion S1, the agitation of the toner becomes insufficient, and therefore, it is feared that image unevenness or density unevenness may be caused by charging failure or agitation failure.

In order to sufficiently perform the agitation between the replenish toner and the developer, it may be considered to lengthen an agitating distance or increase an agitating ability by the improvement of screws. However, the former increases a size of an apparatus, and the latter improves an agitating ability but sacrifices a conveying ability.

SUMMARY OF THE INVENTION

Therefore, it is desirable to provide a developing device, in which a developing chamber is disposed at a vertically lower portion and an agitating chamber is disposed at a vertically upper portion, thereby being capable of sufficiently mixing and agitating a replenish toner and a developer while suppressing an increase in a size of an apparatus or a reduction in a conveying ability.

According to an embodiment of the present invention, a developing device includes: a developing chamber which supplies a developer to a developer bearing member; an agitating chamber which is disposed above the developing chamber in a vertical direction and agitates the developer; a first developer conveying member which is disposed within the developing chamber and conveys the developer; a second developer conveying member which is disposed within the agitating chamber and conveys the developer; a first connecting portion which is formed at one longitudinal end of the developing chamber and the agitating chamber, and pumps the developer from the developing chamber to the agitating chamber; a second connecting portion which is formed at the other longitudinal end of the developing chamber and the agitating chamber and at which the developer falls from the agitating chamber to the developing chamber; and a replenishing portion which replenishes a replenish toner to the developing chamber, wherein the replenishing portion replenishes the replenish toner from a downstream side of the first developer conveying member in a conveying direction, rather than an area facing a developer bearing area of the developer bearing member in the developing chamber, to the developing chamber.

Further features of the present invention will become apparent from the following description of exemplary embodiments with reference to the attached drawings.

DESCRIPTION OF THE EMBODIMENTS

First Embodiment

Figure 1:
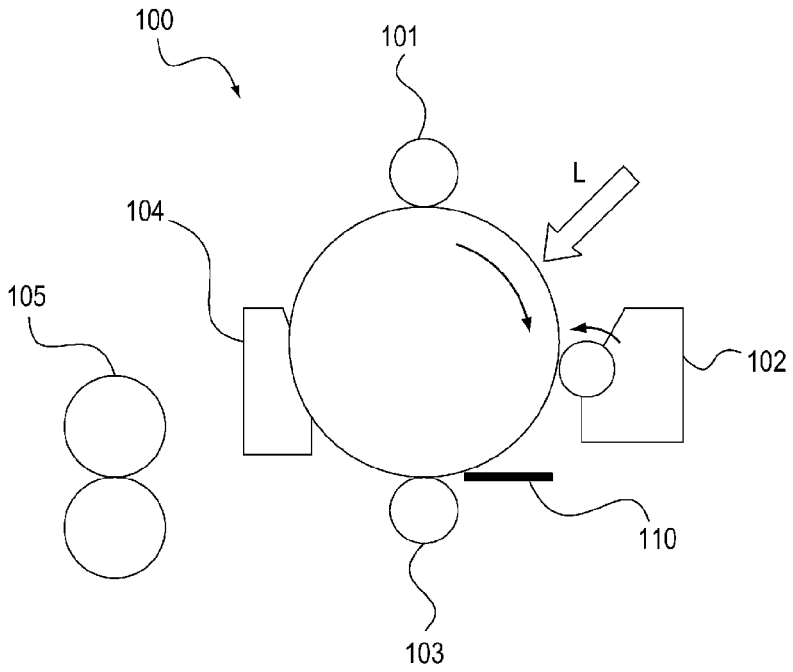
FIG. 1 is a configuration diagram of an image forming apparatus according to a first embodiment.

A first embodiment of a developing device according to the present invention will be described with reference to the drawings. FIG. 1 is a configuration diagram of an image forming apparatus according to a first embodiment.

As illustrated in FIG. 1, in the image forming apparatus 1000 according to the present embodiment, an electrostatic latent image is formed in such a manner that a photosensitive drum (image bearing member) 100 uniformly charged by a charging roller 101 is exposed to a laser L according to image information. The formed electrostatic latent image is developed into a toner image by using a two-component developer, including a magnetic carrier and a non-magnetic toner, by a developing device 102, and is transferred on a sheet 110 by a transfer roller 103.

The sheet 110, on which the toner image is transferred, is pressurized and heated by a fixing device 105. In this manner, the toner image is fixed on the sheet 110, and the sheet 110 is discharged out of the main body of the image forming apparatus. After the toner image is transferred, a residual transfer toner attached to the surface of the photosensitive drum 100 is removed by a cleaner 104, and is supplied for a next image formation.

Figure 2A:
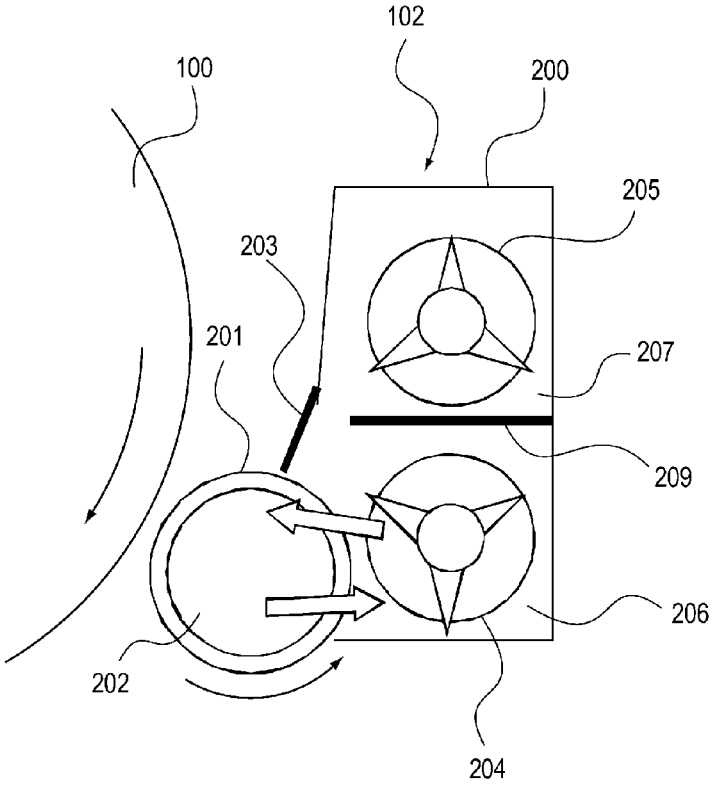
FIG. 2A is a configuration diagram of a developing device according to the first embodiment.
Figure 2B:
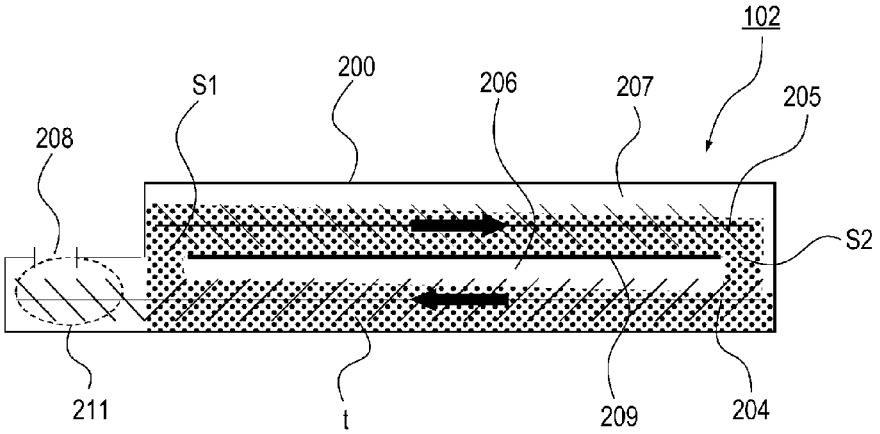
FIG. 2B is a longitudinal sectional view of the developing device according to the first embodiment.

(Developing Device) FIG. 2A is a configuration diagram of the developing device according to the present embodiment. FIG. 2B is a longitudinal sectional view of the developing device according to the present embodiment. As illustrated in FIGS. 2A and 2B, the developing device 102 is configured such that a developing container 200 is separated by a partition wall 209, and an agitating chamber 207 is disposed in a vertically upper portion than a developing chamber 206, so as to save a horizontal space of the image forming apparatus 1000. The partitioned developing chamber 206 and agitating chamber 207 communicate with each other at both ends to allow a developer t to flow therebetween.

At a position of the developing container 200 which faces the photosensitive drum 100, a developing sleeve (developer bearing member) 201 is rotatably provided. At the inside of the developing sleeve 201, a magnet roll (magnetic field generation unit) 202 is provided. The surface of the developing sleeve 201 is rotatable along the outer circumference of the magnet roll 202.

The developer inside the developing chamber 206 is conveyed within the developing chamber by a rotation of a first conveying screw (first developer conveying member) 204, and a part of the developer t is supplied from the developing chamber 206 to the developing sleeve 201 by a magnetic force of the magnet roll 202. The developer supplied to the developing sleeve 201 is conveyed on the circumferential surface of the developing sleeve 201 by the rotation of the developing sleeve 201, and a layer thickness of the developer is regulated by a regulation blade (developer regulating unit) 203. The developer t, the layer thickness of which is regulated, stands in a developing portion by a magnetic force and comes into contact with the surface of the photosensitive drum 100.

Only the toner is shifted to the electrostatic latent image formed on the surface of the photosensitive drum 100 by a developing bias applied to the developing sleeve 201, and a toner image corresponding to the electrostatic latent image is formed on the surface of the photosensitive drum 100. The developer t remaining after developing the electrostatic latent image passes through the developing portion according to the rotation of the developing sleeve 201, is returned to the inside of the developing container 200, is subjected to a magnetic repulsive force, is peeled from the surface of the developing sleeve 201, and is returned to the developing chamber 206.

(Replenishing Port 208) In order to supplement the toner consumed in the developing process, a replenish toner is supplied from the replenishing port 208. The replenish toner is filled into a hopper (not illustrated) connected to the replenishing port 208. The toner replenishment is achieved in such a manner that the replenish toner inside the hopper is guided to the replenishing port 208 by rotating a screw (not illustrated) installed within the hopper.

The replenishing port 208 is provided at a downstream side of the developing chamber 206 in a developer conveyance direction. The replenish toner supplied from the replenishing port 208 is supplied to the developing chamber 206 by a third conveying screw (third developer conveying member) 211 which conveys the replenish toner. The replenish toner is conveyed by the first conveying screw 204 inside the developing chamber 206 while being agitated with a carrier of the developer t within the developing chamber 206. In a communication portion (first connecting portion) S1 provided at a downstream side of the first conveying screw 204 in the conveyance direction, the developer t is pumped from the developing chamber 206 to the agitating chamber 207.

The developer t pumped to the agitating chamber 207 is conveyed to a communication portion (second connecting portion) S2 provided at a downstream side of a second conveying screw (second developer conveying member) 205 in a conveyance direction by the second conveying screw 205 inside the agitating chamber, and falls to the developing chamber 206. By repeating the above operation, the developer t is circulated. The communication portion S1 is formed at one longitudinal end of the developing chamber and the agitating chamber, and the communication portion S2 is formed at the other longitudinal end of the developing chamber and the agitating chamber.

In this case, by providing the replenishing port 208 at the downstream side of the developing chamber 206 in the developer conveyance direction, the replenish toner is sufficiently mixed and agitated with the developer t inside the developing container 200. This mechanism will be described while comparing the present embodiment with the conventional example.

Figure 5A:
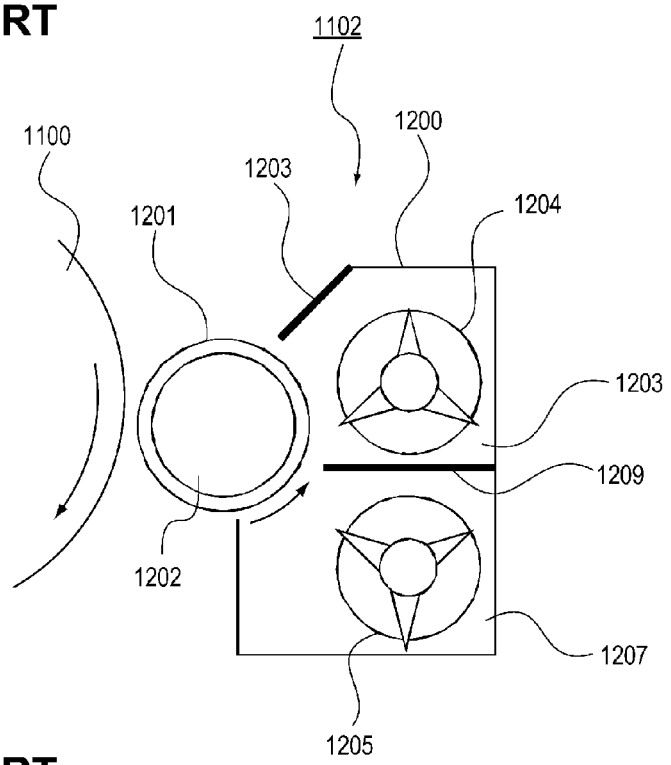
FIG. 5A PRIOR ART
FIG. 5A is a configuration diagram of a conventional developing device.
Figure 5B:
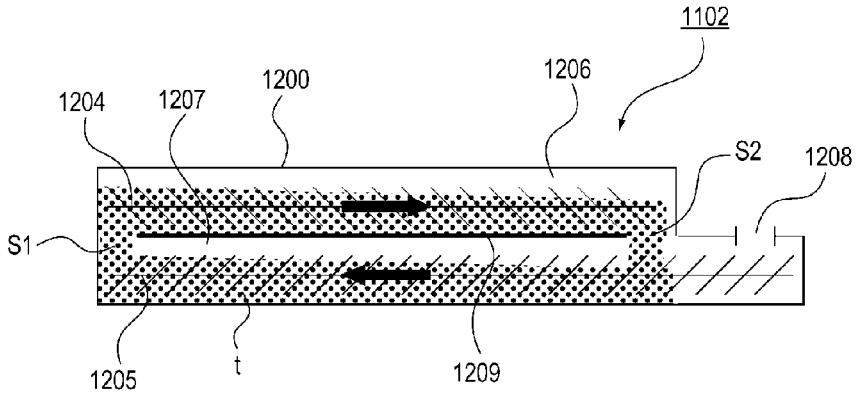
FIG. 5B PRIOR ART
FIG. 5B is a longitudinal sectional view of the conventional developing device.
Figure 6:
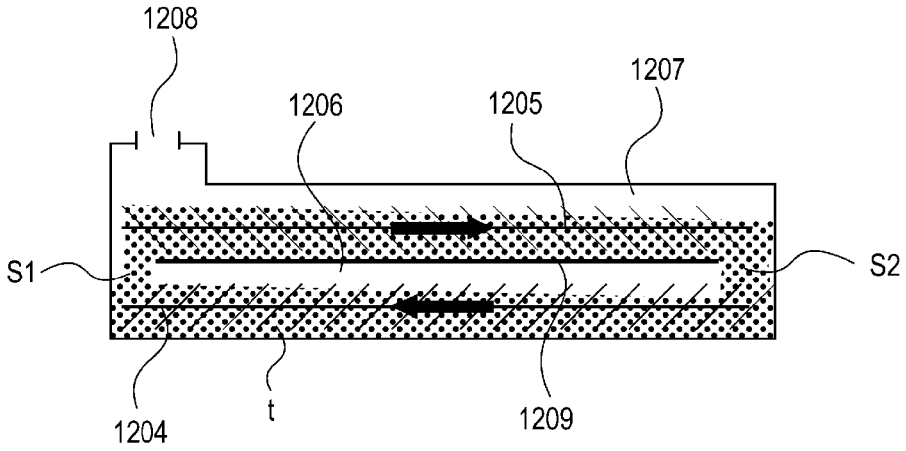
FIG. 6 PRIOR ART
FIG. 6 is a longitudinal sectional view of a conventional developing device in which a toner replenishing port is disposed at an upstream side of an agitating chamber in a developer conveyance direction.

FIG. 5A is a configuration diagram of a conventional developing device. FIG. 5B is a longitudinal sectional view of the conventional developing device. As illustrated in FIGS. 5A and 5B, the conventional developing device 1102 is configured such that a developing chamber 1206 is disposed above an agitating chamber 1207 in a vertical direction, and a replenishing port 1208 is provided at an upstream side of the agitating chamber 1207 in a developer conveyance direction.

Figure 3A:
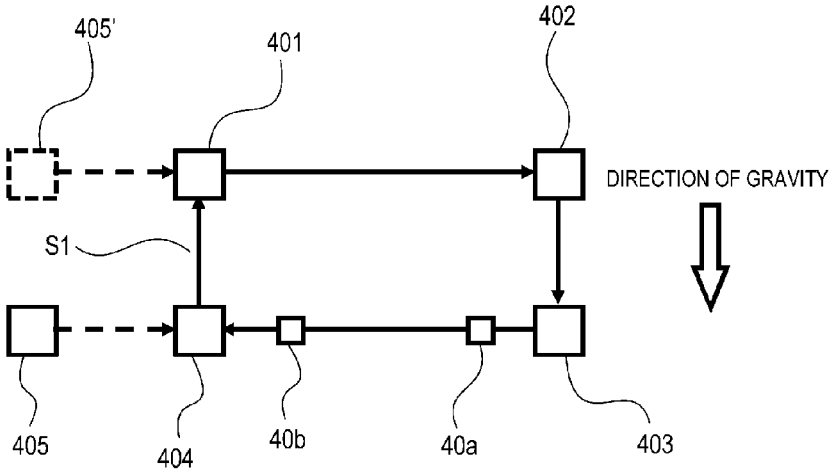
FIG. 3A is a diagram illustrating a circulation of a developer and a conveyance path of a replenish toner in the developing device of the first embodiment.
Figure 3B:
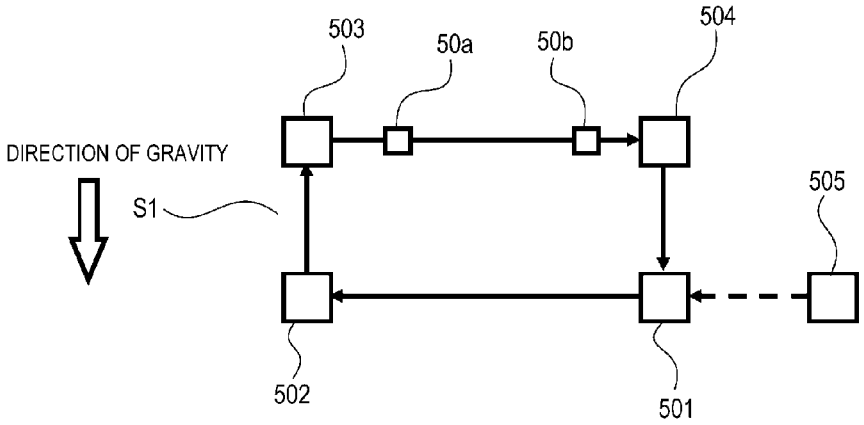
FIG. 3B PRIOR ART
FIG. 3B is a diagram illustrating a circulation of a developer and a conveyance path of a replenish toner in a conventional developing device.

FIG. 3A is a diagram illustrating a circulation of a developer and a conveyance path of a replenish toner in the developing device of the present embodiment. FIG. 3B is a diagram illustrating a circulation of a developer and a conveyance path of a replenish toner in the conventional developing device. In FIGS. 3A and 3B, solid arrows indicate the developer conveyance direction, and dashed arrows indicate the replenish toner conveyance direction.

As illustrated in FIG. 3A, in the developing device 102 of the present embodiment, the developer is conveyed from the upstream 401 of the agitating chamber 207 to the downstream 402 of the agitating chamber 207. Then, the developer falls from the downstream 402 of the agitating chamber 207 to the upstream 403 of the developing chamber 206.

After the fallen developer is conveyed from the upstream 403 of the developing chamber 206 to the downstream 404 of the developing chamber 206, the developer is pressurized by the conveying force of the first conveying screw 204 and is pumped to the upstream 401 of the agitating chamber 207. At that time, in the interval from the upstream 403 to the downstream 404 of the developing chamber 206, the supply of the developer to the developing sleeve 201 is started at a supply start point 40*a*, and the supply of the developer to the developing sleeve 201 is ended at a supply end point 40*b*.

In the present embodiment, a replenishing position 405 at which a toner replenishment is performed from the replenishing port 208 to the developing container 200 is the downstream 404 of the developing chamber 206. For comparison, a virtual replenishing position 405' is added to the upstream 401 of the agitating chamber 207.

As illustrated in FIG. 3B, in the conventional developing device 1102, a replenish toner supplied from a replenishing position 505 disposed at the upstream of the agitating chamber 1207 is conveyed to the upstream 501 of the agitating chamber 1207, the downstream 502 of the agitating chamber 1207, and the upstream 503 of the developing chamber 1206. Since high pressure is applied to the developer, the developer passes through the communication portion S1 (the downstream 502 of the agitating chamber 1207 to the upstream 503 of the developing chamber 1206) at which the replenish toner and the developer are most efficiently mixed and agitated. Then, the developer passes through a supply start point 50*a* toward the developing sleeve 201, a supply end point 50*b*, and the downstream 402 of the developing chamber 1206, and is returned to the upstream 403.

That is, by disposing the replenishing position 505 at the upstream 501 side of the agitating chamber 1207, the replenish toner passes through a place subjected to high pressure until the replenish toner reaches the point 50*a*. Therefore, the replenish toner reaches the developing sleeve 201 in a state of being sufficiently mixed and agitated with the developer, thereby obtaining a good image.

On the other hand, in the configuration of the present embodiment illustrated in FIG. 3A, if the replenishing port 208 is provided at the upstream (virtual replenishing position 405') of the agitating chamber 207 which is considered as the optimal position of the replenishing port 208, the replenish toner does not pass through the communication portion S1. For this reason, the replenish toner is not subjected to high pressure and reaches the supply start point 40*a* without being sufficiently mixed and agitated. As a result, it is feared that an image may become poor. In other words, even when the agitating distance is long, the agitation becomes insufficient if the replenish toner reaches the developing position without being subjected to high pressure.

In this regard, the replenishing position 405 of the replenishing port 208 of the present embodiment is disposed at the downstream 404 of the developing chamber 206. Therefore, until the replenish toner reaches the supply start point 40*a*, the replenish toner passes through the communication portion S1, is subjected to high pressure, and is conveyed to the upstream 401 of the agitating chamber 207 against gravity. Therefore, the replenish toner reaches the supply start point 40*a* in a state of being sufficiently mixed and agitated with the developer, thereby obtaining a good image. In other words, compared with the virtual replenishing position 405' or the conventional case, the agitation length is shortened, but the replenish toner is subjected to high pressure and thus sufficiently mixed and agitated.

Also, in the conventional example, since it is feared that the replenish toner might be directly scattered to the developing sleeve 201 at the supply end point 50*b*, it is difficult to provide the replenishing port 208 at the developing chamber side. However, in the present embodiment, the replenishing port 208 is formed in the longitudinal outer side of the developing chamber 206 rather than the first connecting portion (communication portion S1). Therefore, the replenish toner is not directly scattered to the developing sleeve 201.

In FIG. 3A, although the downstream 404 where the replenish toner is joined with the developer is very close to the supply end point 40*b*, the pressure of the developer is highest at the downstream 404 and an amount of the developer is largest at the downstream 404. Therefore, it is very difficult for the replenish toner to directly reach the supply end point 40*b*.

As described above, in the developing device 102 in which the developing chamber 206 is disposed in the vertically lower portion and the agitating chamber 207 is disposed in the vertically upper portion, the replenishing port 208 is provided at the downstream side of the developing chamber 206 in the developer conveyance direction. In this manner, the replenish toner and the developer can be sufficiently mixed and agitated, while suppressing an increase in the size of the image forming apparatus 1000 or a reduction in the ability to convey the developer. Therefore, image unevenness or density difference occurring in a thrust direction due to insufficient agitation can be suppressed, or a toner which is not controlled by an electric field can be suppressed from covering a white background.

Also, the developer conveying force of the third conveying screw 211 needs to be strong enough to surely convey the replenish toner to the highest pressure place of the downstream portion of the developing chamber 206. Therefore, the conveying ability of the third conveying screw 211 is improved by narrowing a screw pitch, increasing the number of screw blades, or increasing a screw diameter.

For example, the third conveying screw 211 may be the same as the screws 204 and 205. However, the third conveying screw 211 can surely supplement the replenish toner to the inside of the developing container 200 preferably by narrowing the screw pitch of the third conveying screw 211 more than the screw pitches of the screws 204 and 205. Also, both the screws 204 and 205 rotate at a speed of 420 [rpm]. Also, fins form a helical structure around a screw shaft at a period of 3 cm, and the outer circumferential diameter is 1.0 cm.

Also, instead of the replenish toner of the present embodiment, a developer in which a toner and a carrier are mixed may be replenished.

(Experiment) An experiment for evaluating the effects of the present embodiment was conducted. In the experiment, first, 1 g of a toner was replenished from the replenishing port 208 (replenishing position 405), and the developing device 102 was driven. In the similar manner, 1 g of a toner was replenished from the upstream (virtual replenishing position 405') of the agitating chamber 207, and the developing device 102 was driven.

When the replenish toner reached the developing sleeve 201, the driving was stopped. 0.2 g of the developer on the developing sleeve 201 at that point was collected from the upstream side of the developing chamber 206, and a charging amount [μC/mg] was measured. Also, for comparison, a charging amount of the developer prior to the toner replenishment was measured. The charging amount was measured using E-SPARTANALYZER (manufactured by Hosokawa Micron Corporation). In this case, time taken until the replenish toner reached the developing sleeve 201 was previously measured.

Figure 4:
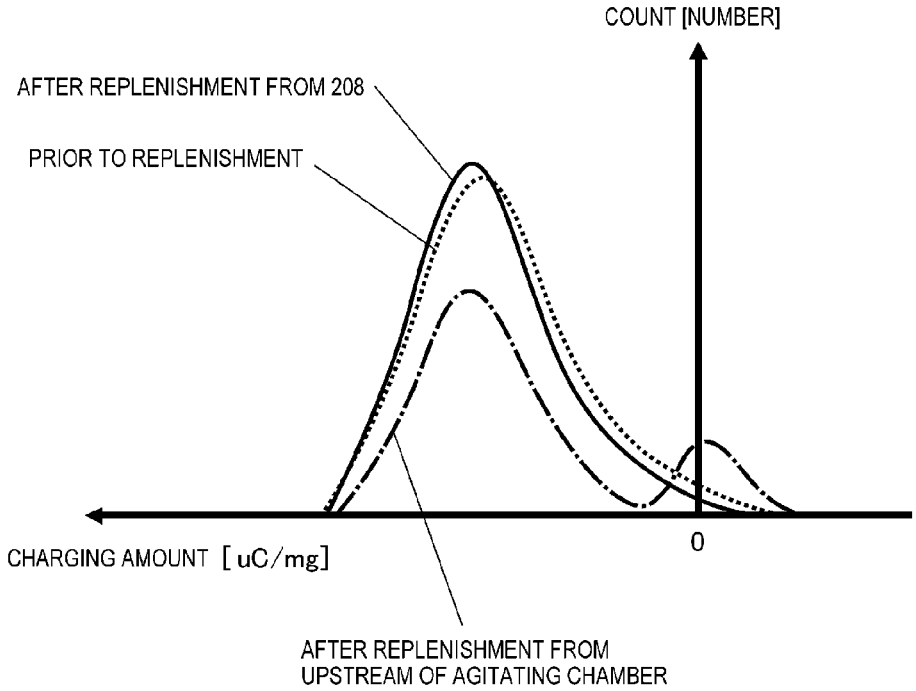
FIG. 4 is a diagram illustrating experimental results.

FIG. 4 is a diagram illustrating experimental results. As illustrated in FIG. 4, when the toner was replenished from the upstream (virtual replenishing position 405') of the agitating chamber 207, toners, charging amounts of which were around zero, were increased as compared with prior to the developer replenishment. Since the toners having small charging amounts were easily scattered, these toners easily become the cause of a poor image. On the other hand, when the toner was replenished from the replenishing port 208 (replenishing position 405), the distribution diagram of the charging amount was hardly changed as compared with prior to the developer replenishment. Therefore, it can be seen that the mixing and agitation was sufficiently performed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-002137, filed Jan. 10, 2012, which is hereby incorporated by reference herein in its entirety.

What is claimed is:

1. A developing device comprising:

a developing chamber which supplies a developer to a developer bearing member;

an agitating chamber disposed above the developing chamber in a vertical direction and agitating the developer;

a first developer conveying member disposed within the developing chamber and conveying the developer;

a second developer conveying member disposed within the agitating chamber and conveying the developer;

a first connecting portion formed at one longitudinal end of the developing chamber and the agitating chamber, and connecting the developing chamber and the agitating chamber so as to convey the developer from the developing chamber to the agitating chamber;

a second connecting portion formed at another longitudinal end of the developing chamber and the agitating chamber and connecting the developing chamber and the agitating chamber so as to convey the developer from the agitating chamber to the developing chamber;

a third developer conveying member disposed on a same axis as the first developer conveying member and able to convey the developer toward the developing chamber at a downstream side from the first connecting portion in a conveying direction of the first developer conveying member; and a supplying portion which supplies developer to the third developer conveying member and is disposed at a position facing the third developer conveying member.

2. The developing device according to claim 1, wherein the first developer conveying member and the third developer conveying member are screws, and the screw of the third developer conveying member has a helical screw blade with a narrower pitch than the screw of the first conveying member.

3. The developing device according to claim 1, wherein the third developer conveying member is a screw having a plurality of helical screw blades.

4. The developing device according to claim 1, wherein the first developer conveying member and the third developer conveying member are screws, and the screw of the third developer conveying member has a helical screw blade with a larger diameter than the screw of the first conveying member.

* * * * *